US008726885B2

(12) United States Patent
Brandt

(10) Patent No.: US 8,726,885 B2
(45) Date of Patent: May 20, 2014

(54) METHOD AND DEVICE FOR DETERMINING A PRESSURE IN A HIGH-PRESSURE ACCUMULATOR

(75) Inventor: Martin Brandt, Wörth a.d. Donau (DE)

(73) Assignee: Continental Automotive GmbH, Hannover (DE)

( * ) Notice: Subject to any disclaimer, the term of this patent is extended or adjusted under 35 U.S.C. 154(b) by 383 days.

(21) Appl. No.: 13/265,667

(22) PCT Filed: Mar. 30, 2010

(86) PCT No.: PCT/EP2010/054189

§ 371 (c)(1),
(2), (4) Date: Oct. 21, 2011

(87) PCT Pub. No.: WO2010/121889

PCT Pub. Date: Oct. 28, 2010

(65) Prior Publication Data

US 2012/0036938 A1 Feb. 16, 2012

(30) Foreign Application Priority Data

Apr. 21, 2009 (DE) ..... 10 2009 018 288

(51) Int. Cl.
*F02M 59/46* (2006.01)
*F02D 41/38* (2006.01)
*F02M 47/02* (2006.01)

(52) U.S. Cl.
USPC ..... 123/478; 701/104; 123/498

(58) Field of Classification Search
USPC ..... 73/753; 701/104, 105; 123/478, 479, 123/498
See application file for complete search history.

(56) References Cited

U.S. PATENT DOCUMENTS 4,791,809 A * 12/1988 Schmidt ..... 73/114.47
6,499,464 B2 12/2002 Rueger ..... 123/446
6,712,047 B2 3/2004 Rueger ..... 123/479
7,681,555 B2 * 3/2010 Hargreaves et al. ..... 123/490

(Continued)

FOREIGN PATENT DOCUMENTS

DE 10014737 A1 10/2001 ..... F02D 41/38
DE 10032022 A1 1/2002 ..... F02D 41/20

(Continued)

OTHER PUBLICATIONS

International PCT Search Report and Written Opinion, PCT/EP2010/054189, 16 pages.

*Primary Examiner* — Lisa Caputo
*Assistant Examiner* — Punam Roy
(74) *Attorney, Agent, or Firm* — King & Spalding L.L.P.

(57) ABSTRACT

An injection valve is hydraulically coupled to a high-pressure accumulator in order to supply a fluid. The injection valve has a longitudinal axis, an injection needle, and an actuator. The actuator is designed to act on the injection needle. A pre-defined amount of electrical energy is supplied to the actuator in order to modify an axial length of the actuator in such a way that the injection needle moves out of the closed position. Once the pre-defined amount of electrical energy has been supplied, a first voltage value and a second voltage value are detected and/or determined by the actuator at respectively different pre-defined moments. On the basis of the first and second voltage values, a differential voltage value is determined, on the basis of which a first pressure is determined, which represents a pressure in the high-pressure accumulator.

16 Claims, 5 Drawing Sheets

(56) References Cited

U.S. PATENT DOCUMENTS

| | | | | |
|---|---|---|---|---|
| 7,822,537 | B2 * | 10/2010 | Perryman et al. | 701/114 |
| 8,051,839 | B2 * | 11/2011 | Spadafora et al. | 123/498 |
| 8,165,783 | B2 * | 4/2012 | Marzahn | 701/104 |
| 2013/0066538 | A1 * | 3/2013 | Brandt et al. | 701/105 |
| 2013/0327301 | A1 * | 12/2013 | Brandt | 123/478 |

FOREIGN PATENT DOCUMENTS

| | | | | |
|---|---|---|---|---|
| DE | 102005057572 | A1 | 6/2007 | F02D 41/20 |
| DE | 102006042664 | A1 | 3/2008 | F02M 65/00 |
| EP | 1541840 | A2 | 6/2005 | F02D 41/20 |
| WO | 01/73282 | A1 | 10/2001 | F02D 41/20 |
| WO | 2005/119038 | A1 | 12/2005 | F02D 41/20 |

* cited by examiner

METHOD AND DEVICE FOR DETERMINING A PRESSURE IN A HIGH-PRESSURE ACCUMULATOR

CROSS-REFERENCE TO RELATED APPLICATIONS

This application is a U.S. National Stage Application of International Application No. PCT/EP2010/054189 filed Mar. 30, 2010, which designates the United States of America, and claims priority to German Application No. 10 2009 018 288.8 filed Apr. 21, 2009, the contents of which are hereby incorporated by reference in their entirety.

TECHNICAL FIELD

The invention relates to a method and to a device for determining a pressure in a high-pressure accumulator. The high-pressure accumulator is hydraulically coupled to an injection valve in order to supply fluid. The injection valve comprises an injection needle, a control valve and an actuator designed as a solid body actuator. The actuator is designed to act on the injection needle. The injection needle is designed to prevent a fluid flow through at least one injection opening in a closed position and otherwise to open up the fluid flow.

BACKGROUND

Injection valves have an injection needle and an actuator. In order to meter a supply of fuel into a cylinder of an internal combustion engine, the injection valve is opened or closed by activation of the injection needle. In order to supply fuel, the injection valve is hydraulically coupled to a high-pressure accumulator. A prerequisite for precise meterability of the fuel into the particular cylinder is precise knowledge of a fuel pressure in the high-pressure accumulator.

SUMMARY

According to various embodiments, a method and a corresponding device can be created which can be used to reliably determine a pressure in the high-pressure accumulator.

According to an embodiment, in a method for determining a pressure in a high-pressure accumulator which is hydraulically coupled to an injection valve in order to supply fluid, wherein the injection valve has a longitudinal axis, an injection needle and an actuator designed as a solid body actuator, wherein the actuator is designed to act on the injection needle, and the injection needle is designed to prevent a fluid flow through at least one injection opening in a closed position and otherwise to open up the fluid flow, a predefined amount of electrical energy is supplied to the actuator in order to modify an axial length of the actuator, specifically in such a manner that the injection needle is moved out of the closed position, after the predefined amount of electrical energy has been supplied, a first and a second voltage value are detected and/or determined by means of the actuator at respectively different predefined moments, a differential voltage value is determined on the basis of the first and second voltage values, a first pressure which is representative of a pressure in the high-pressure accumulator is determined on the basis of the differential voltage value.

According to a further embodiment, the high-pressure accumulator may comprise at least one pressure sensor for detecting a second pressure which is representative of the pressure in the high-pressure accumulator. According to a further embodiment, the first pressure can be determined when the at least one pressure sensor is defective. According to a further embodiment, the first or second pressure can be checked for plausibility with reference to the second or first pressure. According to a further embodiment, the first pressure can be determined on the basis of the differential voltage value with reference to a predefined characteristic diagram, when the pressure sensor is error-free, the second pressure can be detected, the differential voltage value can be determined substantially isochronously, the characteristic diagram can be adapted on the basis of the detected second pressure and the associated differential voltage value. According to a further embodiment, the first voltage value can be detected at a moment at which the voltage across the actuator is at maximum. According to a further embodiment, the second voltage value can be detected and/or determined at a moment at which the voltage across the actuator is virtually stationary. According to a further embodiment, after the predefined amount of electrical energy has been supplied, a plurality of voltage values can be detected, and the first and/or second voltage value can be in each case determined with reference to the formation of a mean of a respective predefined selection of the voltage values detected.

According to another embodiment, a device for determining a pressure in a high-pressure accumulator which is hydraulically coupled to an injection valve in order to supply fluid, wherein the injection valve comprises a longitudinal axis, an injection needle and an actuator designed as a solid body actuator, wherein the actuator is designed to act on the injection needle, and the injection needle is designed to prevent a fluid flow through at least one injection opening in a closed position and otherwise to open up the fluid flow, may be designed—to supply a predefined amount of electrical energy to the actuator in order to modify an axial length of the actuator, specifically in such a manner that the injection needle is moved out of the closed position, after the predefined amount of electrical energy has been supplied, to detect and/or to determine a first and a second voltage value by means of the actuator at respectively different predefined moments, to determine a differential voltage value on the basis of the first and second voltage values, and—to determine a first pressure which is representative of a pressure in the high-pressure accumulator on the basis of the differential voltage value.

BRIEF DESCRIPTION OF THE DRAWINGS

Exemplary embodiments are explained in more detail with reference to the schematic drawings, in which.

Elements of identical construction or function are provided with the same reference symbols throughout the figures.

DETAILED DESCRIPTION

Figure 1:
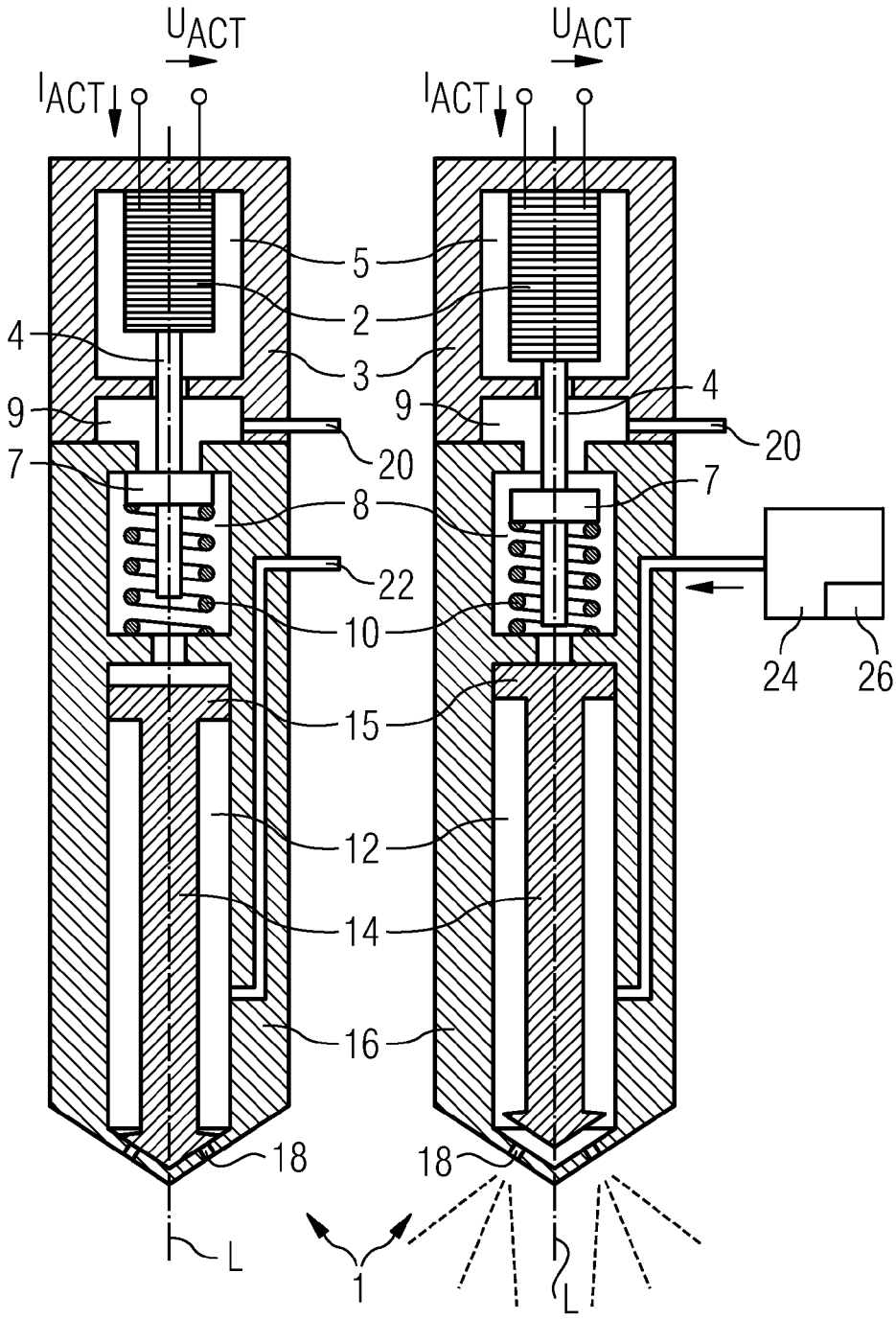
FIG. 1 shows an injection valve in longitudinal section.

According to various embodiments, a method and a corresponding device for determining a pressure in a high-pressure accumulator which is hydraulically coupled to an injection valve in order to supply fluid can be provided. The injection valve comprises a longitudinal axis, an injection needle and an actuator designed as a solid body actuator. The actuator is designed to act on the injection needle. The injection needle is designed to prevent a fluid flow through at least one injection opening in a closed position and otherwise to open up the fluid flow. A predefined amount of electrical energy is supplied to the actuator in order to modify an axial length of the actuator, specifically in such a manner that the injection needle is moved out of the closed position. After the predefined amount of electrical energy has been supplied, a first and a second voltage value are detected and/or determined by means of the actuator at respectively different predefined moments. A differential voltage value is determined on the basis of the first and second voltage values. A first pressure which is representative of a pressure in the high-pressure accumulator is determined on the basis of the differential voltage value. The pressure in the high-pressure accumulator can thereby be determined particularly exactly. In particular, the pressure in the high-pressure accumulator can thereby be determined as an alternative or in addition. The current pressure determined in the high-pressure accumulator can advantageously be used for regulating the pressure of the high-pressure accumulator and therefore for a reliable supply of predefined volumetric flows.

The injection valve is preferably used in an internal combustion engine of a motor vehicle in order to inject fluid and can be designed as a directly or indirectly driven injection valve. An indirectly driven injection valve additionally comprises a control valve, wherein the actuator acts on the control valve, and the control valve acts on the injection needle. In this case, the actuator is preferably mechanically coupled to the control valve and is preferably designed as a piezoactuator. The control valve preferably acts on the injection needle via a hydraulic coupling. The amount of electrical energy is predefined in such a manner that the injection needle is moved out of the closed position thereof and therefore fluid is injected.

In an embodiment, the high-pressure accumulator comprises at least one pressure sensor for detecting a second pressure which is representative of the pressure in the high-pressure accumulator. This permits a redundant determination of the pressure in the high-pressure accumulator. The first and second pressure each represent the pressure in the high-pressure accumulator and permit a redundant and independent determination of the pressure in the high-pressure accumulator.

In a further embodiment, the first pressure is determined when the at least one pressure sensor is defective. This permits an alternative determining of the pressure in the high-pressure accumulator and therefore reliable operation of the internal combustion engine.

In a further embodiment, the first or second pressure is checked for plausibility with reference to the second or first pressure. This permits particularly reliable detection of an error of the injection valve or of the pressure sensor.

In a further embodiment, the first pressure is determined on the basis of the differential voltage value with reference to a predetermined characteristic diagram. When the pressure sensor is error-free, the second pressure is detected. The differential voltage value is determined substantially isochronously. The characteristic diagram is adapted on the basis of the second pressure detected and the associated differential voltage value. The characteristic diagram represents a dependency of the respective differential voltage signal on the respective first pressure. By means of the adaption of the characteristic diagram, a particularly exact pressure in the high-pressure accumulator can be associated with the respective differential voltage value. In the event of a subsequent error of the pressure sensor, the pressure in the high-pressure accumulator can be determined particularly exactly.

In a further embodiment, the first voltage value is detected at a moment at which the voltage across the actuator is at maximum. A maximum voltage across the actuator represents a maximum force which acts on the actuator. Said maximum force comprises a force component assigned to the pressure in the high-pressure accumulator. On account of taking the maximum voltage value into consideration, a particularly exact determining of the pressure in the high-pressure accumulator can be achieved.

In a further embodiment, the second voltage value is detected and/or determined at a moment at which the voltage across the actuator is virtually stationary. This permits a particularly high correlation of the differential voltage signal determined with the pressure in the high-pressure accumulator.

In a further embodiment, after the predefined amount of electrical energy has been supplied, a plurality of voltage values is detected. The first and/or second voltage value are/is in each case determined with reference to the formation of a mean of a respective predefined selection of the voltage values detected. This serves to particularly exactly determine the pressure in the high-pressure accumulator. The voltage values which are taken into consideration for the determination of the second voltage value are preferably detected after a predefined minimum period of time after detection of the first voltage value, in particular whenever the voltage across the actuator only changes insignificantly, i.e. is virtually stationary.

The method and the corresponding device can preferably be used in an injection system having a plurality of injection valves of corresponding design. In this case, for each of the injection valves, a first pressure is determined in each case according to the method or by means of the device and the pressure in the high-pressure accumulator is determined on the basis of said pressure. This has the advantage that the pressure in the high-pressure accumulator can be determined redundantly.

FIG. 1 illustrates an indirectly driven injection valve 1 in two longitudinal sections. The injection valve 1 can be used, for example, as a fuel injection valve for an internal combustion engine of a motor vehicle.

The injection valve 1 comprises a longitudinal axis L, an injection needle 14, a control valve 7 and an actuator 2 designed as a solid body actuator. The actuator 2 is preferably designed as a piezoactuator. The control valve 7 is mechanically coupled to the actuator 2.

The injection valve 1 comprises a housing body 3 with a membrane space 9 and an actuator space 5 in which the actuator 2 is arranged. The injection valve 1 furthermore comprises a nozzle body 16, which comprises a control space 8 and a valve space 12. The nozzle body 16 furthermore comprises injection openings 18 via which fluid is injected into a combustion space of the internal combustion engine when the injection valve 1 is open. The control valve 7 and a spring 10 are arranged in the control space 8, and the injection needle 14 is arranged in the valve space 12. The membrane space 9 is hydraulically coupled to the control space 8, and the control space 8 is hydraulically coupled to the valve space 12. The control space 8 and the valve space 12 are hydraulically coupled via an inflow 22 to a high-pressure accumulator 24 in order to supply fluid. Fluid is stored in the high-pressure accumulator 24 at a predefined pressure, for example between 200 and 2000 bar, which can be detected by means of a pressure sensor 26 assigned to the high-pressure accumulator 24. During operation of the internal combustion engine, the membrane space 9, the control space 8 and the valve space 12 are filled with fluid. The membrane space 5 is hydraulically coupled via a return 20 to a low-pressure accumulator, for example a fuel tank.

The actuator 2 is designed to act on the control valve 7 and, in the process, to control a pressure ratio between the control space 8 and the valve space 12. The movement of the control valve 7 is influenced, firstly, by a resulting force ratio on the basis of the pressure ratio between the control and membrane spaces 8, 9 and, secondly, by the force applied to the control valve 7 by the actuator 2.

Figure 3:
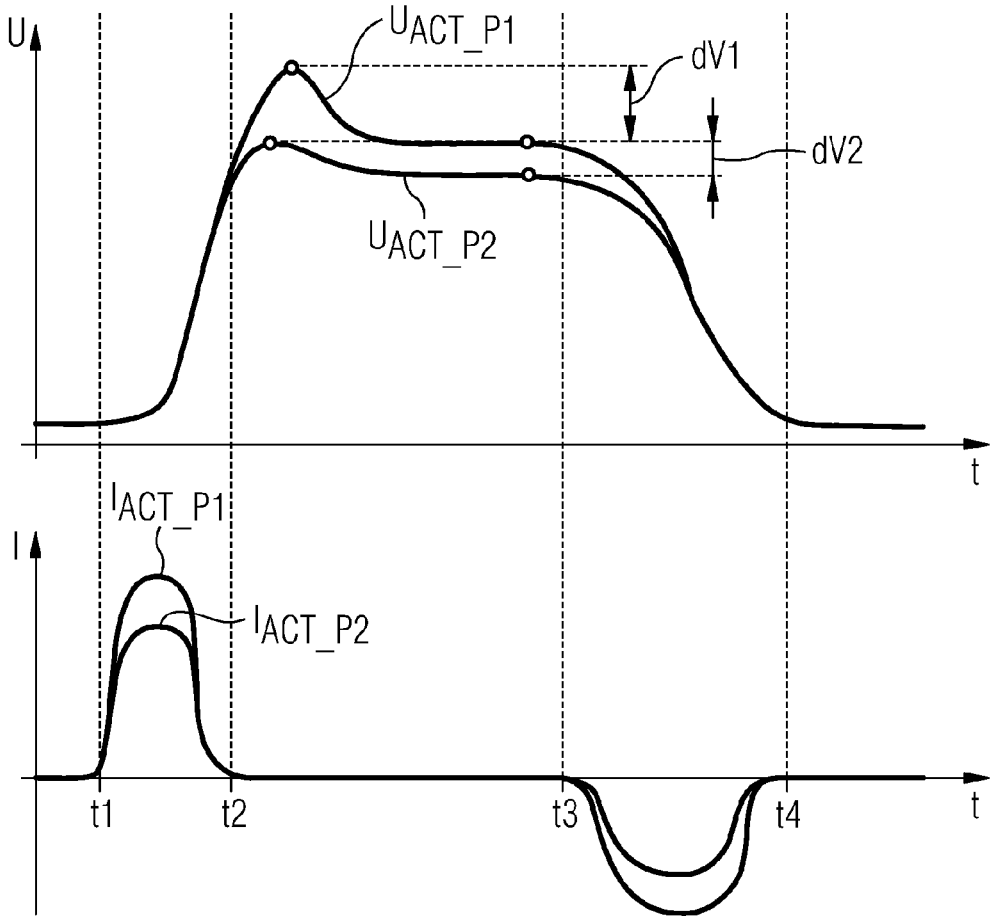
FIGS. 3, 4 show profiles of a voltage across an injection valve.

FIG. 3 represents a charging phase by a period of time between the moments t1 and t2, a holding phase by a period of time between the moments t2 and t3, and a discharging phase by means of a period of time between the moments t3 and t4.

Figure 2:
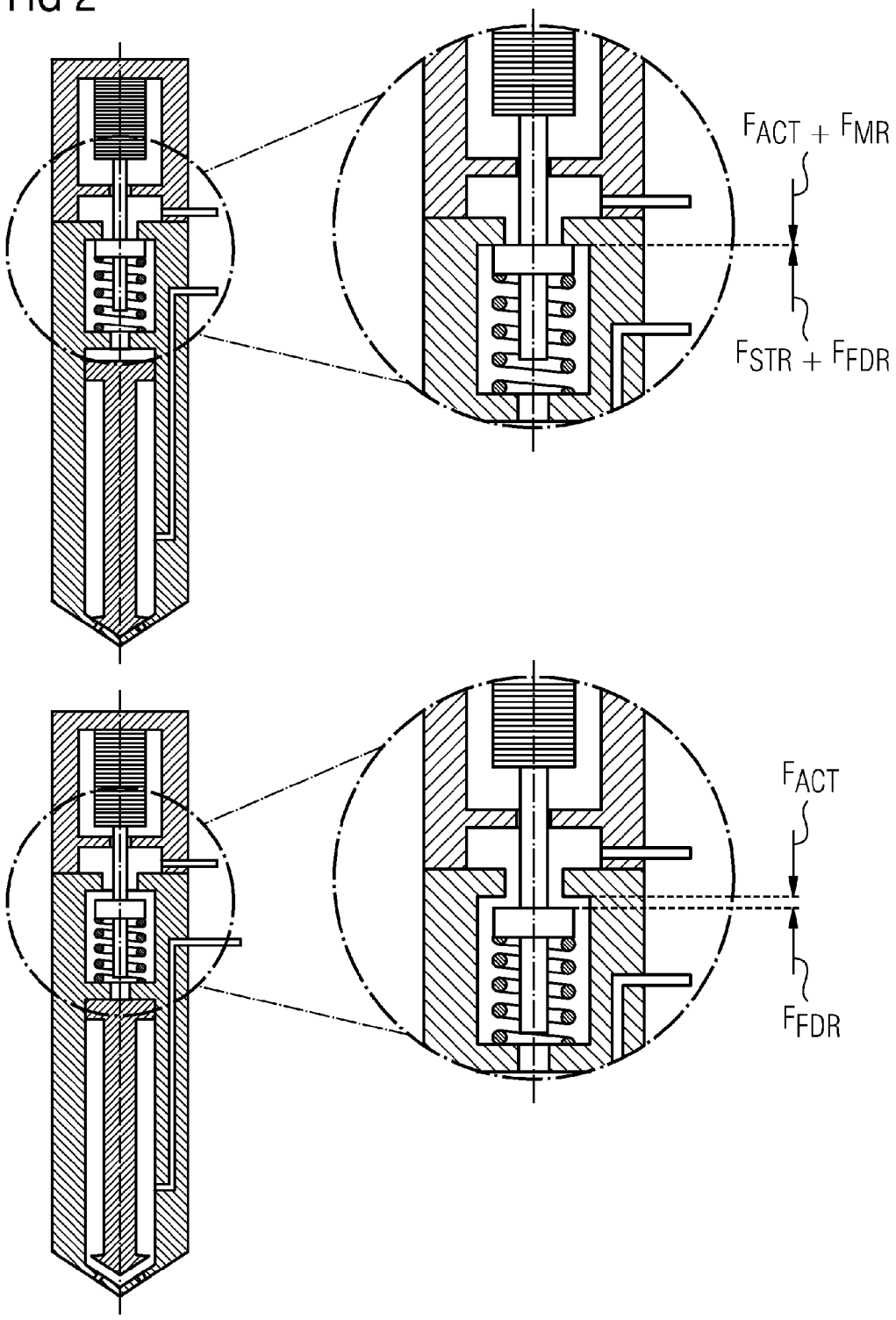
FIG. 2 shows force ratios in the injection valve.

In the charging phase (FIG. 3), the actuator 2 is acted upon with a predefined amount of electrical energy E, for example is energy-controlled. In the process, the actuator 2 is acted upon by an actuator current $I_{ACT}$ and the amount of electrical energy E applied is preferably determined using the mathematical relationship $E=0.5\cdot\int I_{ACT}dt\cdot U_{ACT}$. An actuator voltage $U_{ACT}$ across the actuator 2 rises and, owing to the piezoelectrical effect, the actuator 2 expands axially and exerts an actuator force $F_{ACT}$ (FIG. 2), which is dependent on the actuator voltage $U_{ACT}$, on the control valve 7. If the actuator force $F_{ACT}$ exceeds a counterforce which is dependent on the pressure in the high-pressure accumulator and results from a spring force $F_{FDR}$ associated with the spring 10 and a fluid force $F_{STR}$ in the control space 8, then the control valve 7 is moved axially and opens. The energization of the actuator 2 is interrupted approximately at the moment t2. At this moment t2, the holding phase begins, in which the fluid pressure $F_{STR}$ (FIG. 2) in the control space 8 is dissipated. The injection needle 14 is raised on account of the pressure difference and opens the injection openings 18 in order to inject fluid. In order to end the injection, the actuator 2 is discharged from the moment t3 and therefore the amount of electrical energy E stored in the actuator 2 is dissipated. The actuator 2, which is designed as a piezoactuator, contracts and therefore moves the control valve 7 axially to the effect that the latter closes. The fluid pressure $F_{STR}$ (FIG. 2) in the control space 9 is built up again and the injection needle 14 is correspondingly moved axially in such a manner that it finally closes and therefore ends the injection of fluid.

The dissipation of the fluid pressure $F_{STR}$ in the control space 8 during the holding phase results in the force on the actuator 2 decreasing and the actuator voltage $U_{ACT}$ changing, preferably dropping, during the holding phase.

Figure 4:
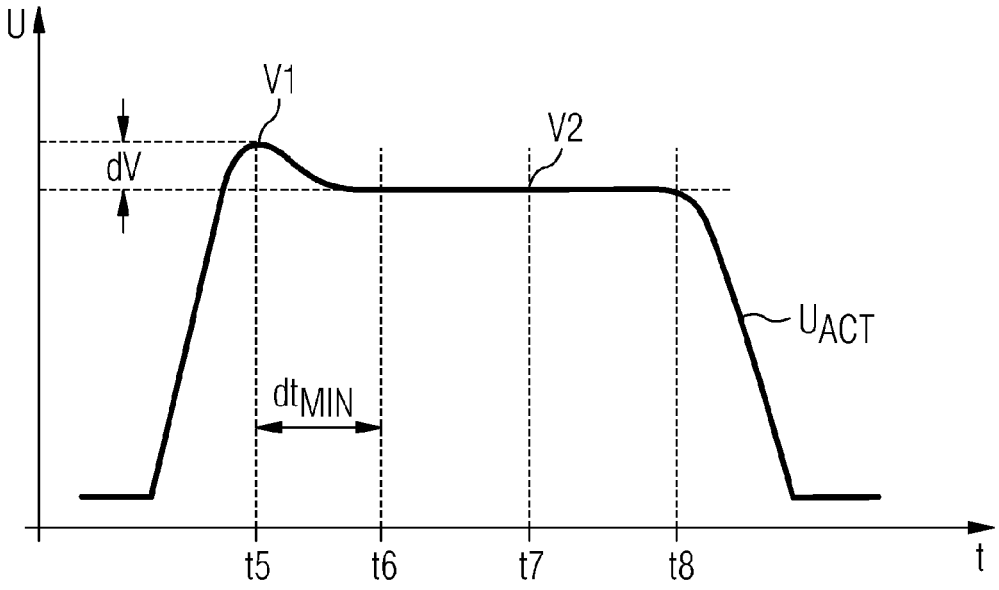

In one embodiment (FIG. 4), with reference to a profile of the actuator voltage $U_{ACT}$, a first voltage value V1 is detected at a first predefined moment t5, and a second voltage value V2 is detected at a second predefined moment t7 lying between a moment t6 and t8. The first moment t5 is preferably predefined in such a manner that the first voltage value V1 represents a maximum of the actuator voltage $U_{ACT}$ across the actuator 2. The second moment t7 is selected preferably after a predefined minimum period of time $dt_{MIN}$ after the first moment t5 and before a moment t8 which represents the beginning of the discharging phase. The minimum period of time $dt_{MIN}$ here is predefined in such a manner that a change in the actuator voltage $U_{ACT}$ across the actuator 2 is substantially decreased, i.e. is virtually stationary. The predefined minimum period of time $dt_{MIN}$ can be determined, for example, in a test stand.

As an alternative, after the predefined minimum period of time $dt_{MIN}$, i.e. after the moment t6, a plurality of voltage values is detected and the second voltage value V2 is determined with reference to the formation of a mean of the detected voltage values. A determination of the first voltage value V1 is basically also possible by means of the formation of a mean.

FIG. 3 illustrates a first and second profile of the actuator voltage $U_{ACT_P1}$, $U_{ACT_P2}$ and a first and second associated profile of the actuator current $I_{ACT_P1}$, $I_{ACT_P2}$. The first profile of the actuator voltage $U_{ACT_P1}$ and the first profile of the actuator current $I_{ACT_P1}$ are associated with a first pressure in the high-pressure accumulator 24, for example 1200 bar. The second profile of the actuator voltage $U_{ACT_P2}$ and the second profile of the actuator current $I_{ACT_P2}$ are associated with a second pressure in the high-pressure accumulator 24, for example 400 bar. Different differential voltage values dV1, dV2 result from the respective profiles of the actuator voltage $U_{ACT_P1}$, $U_{ACT_P2}$.

Figure 5:
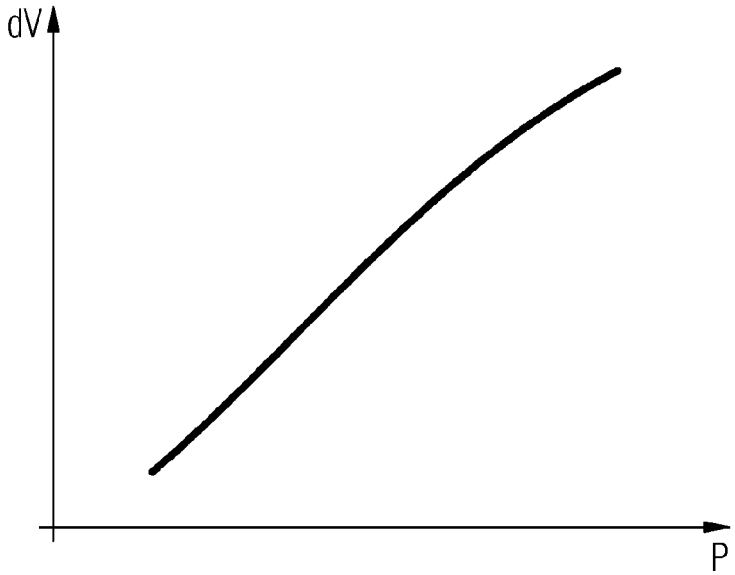
FIG. 5 shows the relationship between the differential voltage value and pressure in the high-pressure accumulator.

The differential voltage value dV, which is proportional to a pressure difference between a pressure $F_{MR}$ in the membrane space 9 (FIG. 2) and the fluid pressure $F_{sTR}$ in the control space 8 and is therefore proportional to the pressure in the high-pressure accumulator 24, is determined on the basis of the first and second voltage values V1, V2. A dependency between the respective differential voltage value dV and the pressure P in the high-pressure accumulator 24 is illustrated with reference to FIG. 5. Said dependency is preferably present in the form of a characteristic diagram in a memory. On the basis of the differential voltage value dV determined, the pressure P in the high-pressure accumulator is determined with reference to the characteristic diagram, preferably whenever the pressure sensor 26 is detected as being defective.

In a further embodiment, the pressure P in the high-pressure accumulator 24 is detected with reference to an error-free pressure sensor 26. The associated differential voltage value dV is determined substantially isochronously. The characteristic diagram is adapted with reference to the pressure P and the associated differential voltage value dV.

Figure 6:
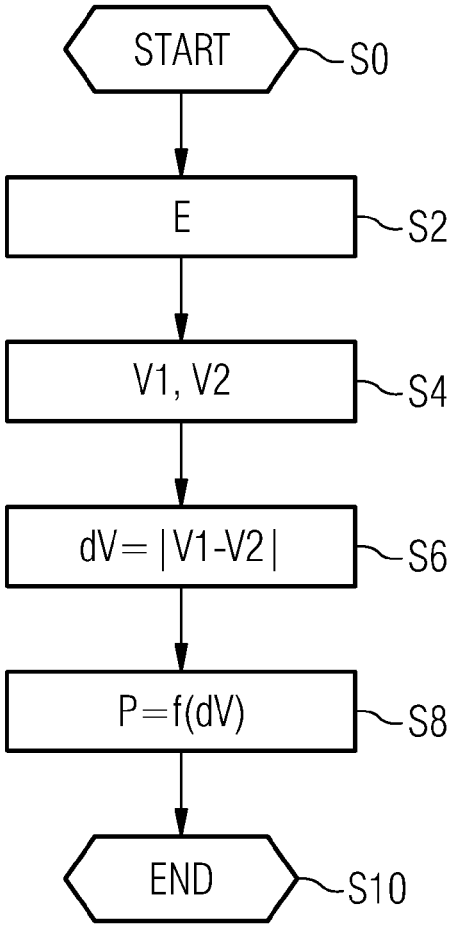
FIG. 6 shows a flow diagram.

A corresponding method for determining the pressure in the high-pressure accumulator is explained with reference to FIG. 6. The method may be executed, for example, in a control unit of the motor vehicle. A control unit of this type may be referred to as a device for determining the pressure in the high-pressure accumulator.

The method is started in a step S0, for example in an injection phase. In a step S2, the predefined amount of electrical energy E is supplied to the actuator 2. On the basis of the resulting profile of the actuator voltage $U_{ACT}$, a first and second voltage value V1, V2 are detected and/or determined in a step S4. On the basis thereof, the differential voltage value dV is determined in a step S6. In a step S8, the pressure P in the high-pressure accumulator 24 is determined on the basis of the differential voltage value dV, for example with reference to the characteristic diagram according to FIG. 5, which is preferably stored in a memory of the control unit. The method is ended in a step S10.

The method and the device can be used in injection systems having a plurality of injection valves 1. This has the advantage that the pressure P in the high-pressure accumulator 24 is determined redundantly. For this purpose, each injection valve 1 is preferably assigned an individual characteristic diagram which can in each case also be adapted if a pressure sensor 26 is error-free. If a pressure sensor 26 is error-free, the detected pressure thereof can be checked for plausibility by means of the pressure determined, or vice versa. The injection system having one or more injection valves 1 can be designed as a pressure control valve system, in which the pressure in the high-pressure accumulator 24 is regulated with the aid of a pressure regulating valve, wherein the pressure difference between the pressure increase owing to the delivery from the high-pressure pump and the pressure drop owing to the injection into the combustion space is compensated for by means of a controlled leakage. As an alternative or in addition, the injection valve can have a volume control valve for influencing the volumetric flow of the high-pressure pump, said valve determining the volumetric flow on the basis of the current fuel requirement and of the pressure in the high-pressure accumulator.

What is claimed is:

1. A method for determining a pressure in a high-pressure accumulator which is hydraulically coupled to an injection valve in order to supply fluid, wherein the injection valve has a longitudinal axis, an injection needle and an actuator designed as a solid body actuator, wherein the actuator is designed to act on the injection needle, and the injection needle is designed to prevent a fluid flow through at least one injection opening in a closed position and otherwise to open up the fluid flow, the method comprising:

supplying a predefined amount of electrical energy to the actuator in order to modify an axial length of the actuator, specifically in such a manner that the injection needle is moved out of the closed position, after the predefined amount of electrical energy has been supplied, determining a first and a second voltage value by means of the actuator at respectively different predefined moments, determining a differential voltage value on the basis of the first and second voltage values, and determining a first pressure which is representative of a pressure in the high-pressure accumulator on the basis of the differential voltage value.

2. The method according to claim 1, in which the high-pressure accumulator comprises at least one pressure sensor for detecting a second pressure which is representative of the pressure in the high-pressure accumulator.

3. The method according to claim 1, wherein the first pressure is determined when the at least one pressure sensor is defective.

4. The method according to claim 1, wherein the first or second pressure is checked for plausibility with reference to the second or first pressure.

5. The method according to claim 1, further comprising:

determining the first pressure on the basis of the differential voltage value with reference to a predefined characteristic diagram, when the pressure sensor is error-free, detecting the second pressure is, determining the differential voltage value substantially isochronously, and adapting the characteristic diagram on the basis of the detected second pressure and the associated differential voltage value.

6. The method according to claim 1, wherein the first voltage value is detected at a moment at which the voltage across the actuator is at maximum.

7. The method according to claim 1, wherein the second voltage value is determined at a moment at which the voltage across the actuator is virtually stationary.

8. The method according to claim 1, wherein after the predefined amount of electrical energy has been supplied, a plurality of voltage values is detected, and at least one of the first and second voltage value is in each case determined with reference to the formation of a mean of a respective predefined selection of the voltage values detected.

9. A device for determining a pressure in a high-pressure accumulator which is hydraulically coupled to an injection valve in order to supply fluid, wherein the injection valve comprises a longitudinal axis, an injection needle and an actuator designed as a solid body actuator, wherein the actuator is designed to act on the injection needle, and the injection needle is designed to prevent a fluid flow through at least one injection opening in a closed position and otherwise to open up the fluid flow, wherein the device is designed to supply a predefined amount of electrical energy to the actuator in order to modify an axial length of the actuator, specifically in such a manner that the injection needle is moved out of the closed position, after the predefined amount of electrical energy has been supplied, to detect and/or to determine a first and a second voltage value by means of the actuator at respectively different predefined moments, to determine a differential voltage value on the basis of the first and second voltage values, to determine a first pressure which is representative of a pressure in the high-pressure accumulator on the basis of the differential voltage value.

10. The device according to claim 9, wherein the high-pressure accumulator comprises at least one pressure sensor for detecting a second pressure which is representative of the pressure in the high-pressure accumulator.

11. The device according to claim 9, wherein the first pressure is determined when the at least one pressure sensor is defective.

12. The device according to claim 9, wherein the first or second pressure is checked for plausibility with reference to the second or first pressure.

13. The device according to claim 9, wherein the device is furthermore configured:

to determine the first pressure on the basis of the differential voltage value with reference to a predefined characteristic diagram, when the pressure sensor is error-free, to detect the second pressure, to determine the differential voltage value substantially isochronously, and to adapt the characteristic diagram on the basis of the detected second pressure and the associated differential voltage value.

14. The device according to claim 9, wherein the first voltage value is detected at a moment at which the voltage across the actuator is at maximum.

15. The device according to claim 9, wherein the second voltage value is determined at a moment at which the voltage across the actuator is virtually stationary.

16. The device according to claim 9, wherein the device is further configured to detect, after the predefined amount of electrical energy has been supplied, a plurality of voltage values, and to determine at least one of the first and second voltage value in each case with reference to the formation of a mean of a respective predefined selection of the voltage values detected.

* * * * *